United States Patent [19]

Miller

[11] Patent Number: 5,006,968

[45] Date of Patent: Apr. 9, 1991

[54] WALL MOUNTED LAMP WITH ADJUSTABLE PATTERN OF ILLUMINATION

[76] Inventor: Elmo E. Miller, 8201 16th St., Apt. 1126, Silver Spring, Md. 20910

[21] Appl. No.: 457,833

[22] Filed: Dec. 27, 1989

[51] Int. Cl.[5] ..... F21S 1/02

[52] U.S. Cl. ..... 362/147; 362/432; 362/372; 362/413

[58] Field of Search ..... 362/145, 147, 285, 287, 362/288, 351, 358, 368, 370, 371, 372, 382, 418, 429, 430, 431, 433, 319

[56] References Cited

U.S. PATENT DOCUMENTS

| | | | |
|---|---|---|---|
| 2,113,134 | 5/1938 | Godfrey | 362/432 |
| 2,231,137 | 2/1941 | Ohm | 362/432 |
| 2,503,974 | 4/1950 | Sparaco | 362/371 |
| 2,834,875 | 5/1958 | Grohskopf | 362/351 |
| 2,857,509 | 10/1958 | Fuller | 362/319 |
| 3,281,589 | 10/1966 | Cronan | 362/319 |
| 3,764,801 | 10/1973 | Mainieks | 362/352 |
| 4,173,037 | 10/1979 | Henderson, Jr. et al. | 362/368 |
| 4,383,291 | 5/1983 | Gall | 362/352 |
| 4,392,190 | 7/1983 | Upton | 362/281 |
| 4,533,984 | 8/1985 | Gatton | 362/372 |
| 4,692,850 | 9/1987 | LeDoux | 362/419 |
| 4,874,991 | 10/1989 | Ruskin | 362/413 |

FOREIGN PATENT DOCUMENTS

| | | | |
|---|---|---|---|
| 649683 | 1/1951 | United Kingdom | 362/372 |

*Primary Examiner*—Stephen F. Husar
*Assistant Examiner*—D. M. Cox

[57] ABSTRACT

A wall mounted lamp in which a bulb can be moved vertically within a shade to adjust its pattern of illumination. The bulb is suspended by its cord from a cane shaped tube, within which the cord is moved by a straight tube, which extends below the fixture for making the adjustment and to keep the cord neat. The lampshade has foil lining, a corrugated paper core, and flexible edge molding, so its covering can be changed easily. A simple plumb-and-distance instrument facilitates installation. Spring brackets keep the mounting snug and resist lifting the lamp off its mounting screws.

10 Claims, 2 Drawing Sheets

FIG. 1
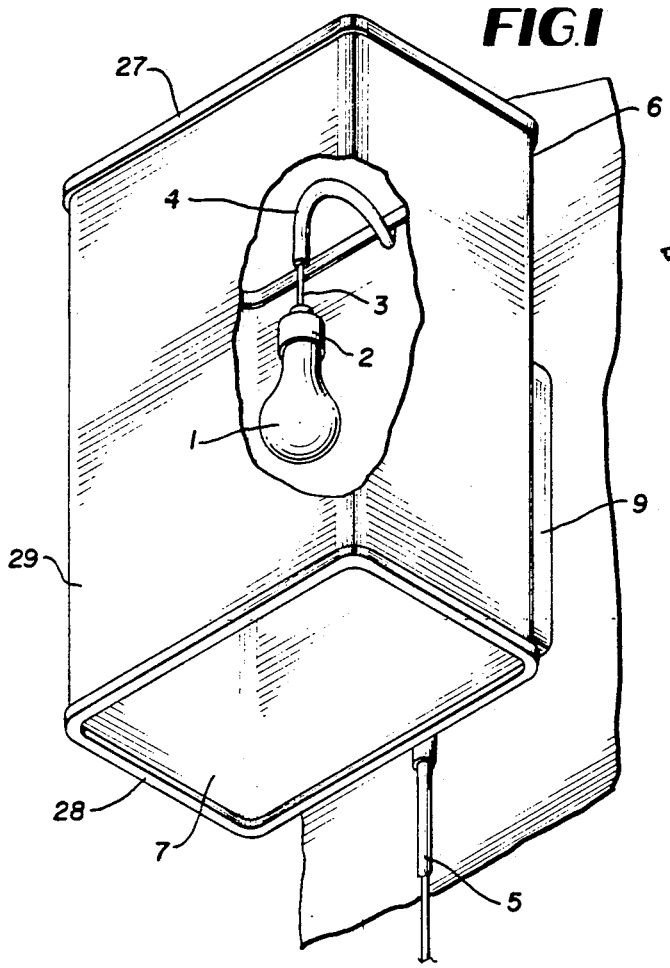
FIG. 2
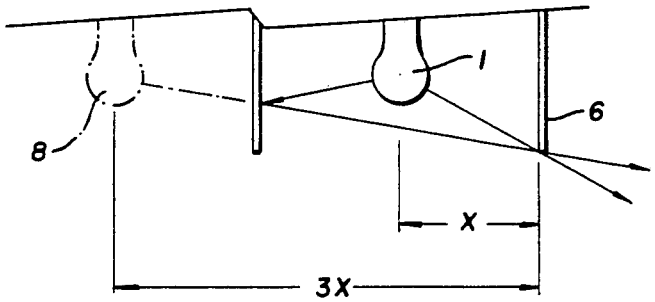
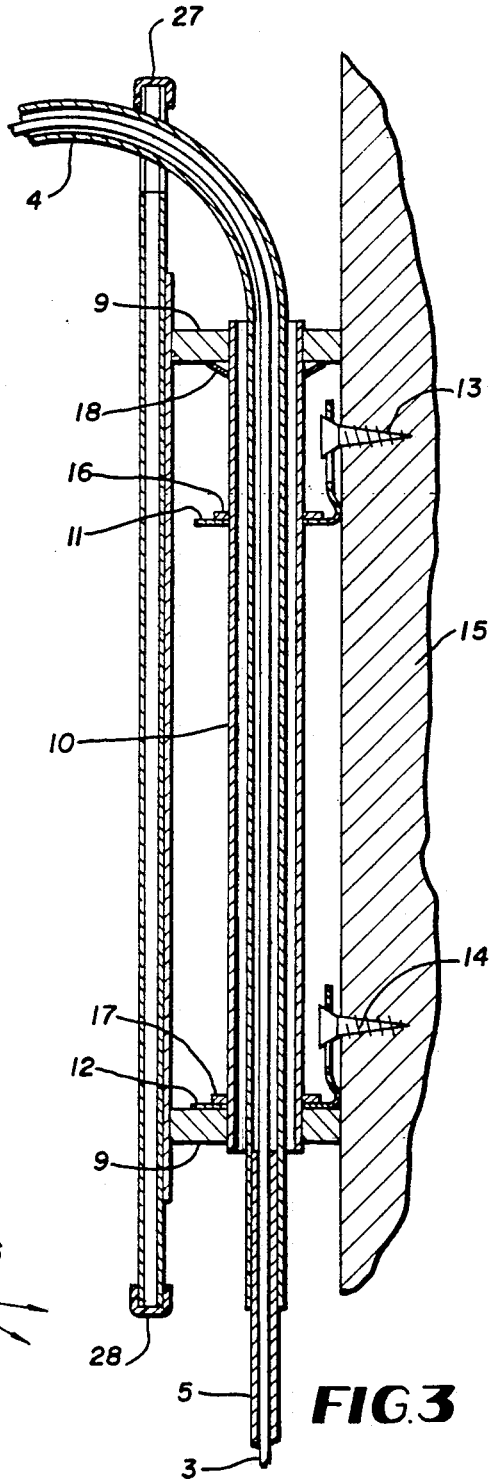
FIG. 3

WALL MOUNTED LAMP WITH ADJUSTABLE PATTERN OF ILLUMINATION

BACKGROUND OF THE INVENTION

This invention relates to an improvement in lighting fixtures, and more particularly to a lamp with an improved means of adjustment to provide efficient, glare-free illumination for reading without shining in one's eyes, or to provide mostly upward indirect illumination.

The most common kind of lighting is over the shoulder of a seated person, with a shade to keep light from shining directly in the eyes of that person or of anyone else in the room. The most common method of adjustment is to tilt a shade to provide task lighting, but not so much as to shine in one's eyes. This generally involves rotation around a harp wire, which involves an extra step: turning the lamp so that the shade tilts in the intended direction. Such handling soils a shade, which is not easily cleaned. Fuller's lamp (U.S. Pat. No. 2,857,509) has a vertically adjustable shade, but the means of adjustment is more complex than that of the present invention, which involves moving the bulb by its cord. Ohm and Godfrey (U.S. Pat. Nos. 2,231,137 and 2,113,134) each moved the bulb vertically by its cord, but not with respect to a shade, and neither provides a convenient means of moving the cord that is comparable to that of the present invention.

Illumination should also be glare-free and efficient in terms of lumens per watt, both of which can be achieved by lining the shade with reflective material. Reducing glare is a function of angular dispersion of the effective light source with respect to the task, and can be achieved with a large reflective shade that is not circular around the bulb. Also, a reflective lining increases the effectiveness of adjusting the bulb vertically with respect to the shade, as discussed above, because as the bulb is lowered, the shift toward lateral illumination is much greater for reflected than for direct rays.

Mounting a lamp on a wall is advantageous because end tables can be put to better use, and floor lamps are expensive and heavy. In mounting, at least two points should be attached for stability. Positioning two attachments on a wall involves the difficulty of determining verticality and distance simultaneously, so the invention provides a simple instrument to do this.

It is also desirable to be able to change the covering on a shade for any decor, and to keep the cord neat. Lamp manufacture tends to be labor intensive and to use expensive materials, so it is desirable to find ways to reduce these costs. Finally, a mass produced lamp should be compact for shipment; therefore, this invention is designed so that all parts can be packed within the shade.

SUMMARY OF THE INVENTION

This invention relates to a wall mounted lamp in which the bulb is suspended within a stationary shade by its cord. The bulb can be positioned easily to illuminate a book without shining in one's eyes, or raised to provide mostly indirect lighting. The means for this adjustment is exceedingly simple: a cane shaped tube from which the bulb is suspended, and a straight tube that moves the cord and also keeps the cord neat below the fixture. The shade is lined with foil for efficiency, to reduce glare, and to increase lateral illumination. Its shape, a rectangular tube with rounded corners, is architecturally elegant, and its appearance is enhanced by its distance from the wall and its reflective mounting. The lamp is also appropriate for lighting corners and hallways if mounted somewhat higher. The shade and its mount are economically constructed with a core of corrugated paper. The shade has a flexible edge molding, fashioned to be easy to take off and put on, so that the shade's covering can readily be changed. The lamp is easy to mount on two screws, with spring brackets that keep it snug against the wall and resist lifting the lamp off the screws. A simple plumb-and-distance instrument is provided for positioning the mounting screws.

DESCRIPTION OF THE DRAWINGS

FIG. 1 is a partial sectional perspective view of the invention.

FIG. 2 is a diagram for comparing reflected and direct illumination in the invention.

FIG. 3 is a sectional view of the shade mount.

DETAILED DESCRIPTION

Figure 4:
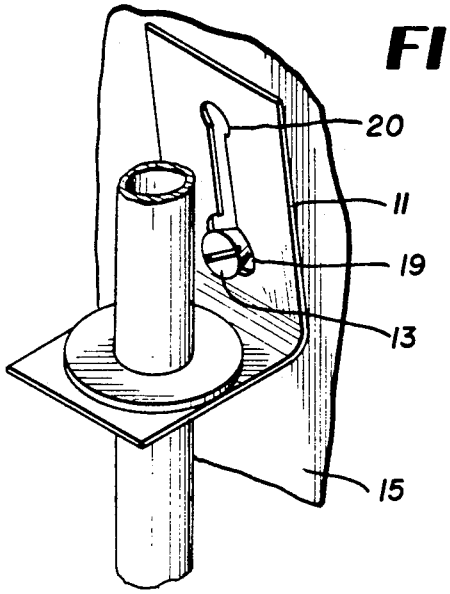
FIG. 4 is an enlarged perspective view of a spring bracket and mounting screw.

In FIG. 1 a bulb 1 and socket 2 are attached to an electric cord 3, which passes through a cane shaped tube 4 and straight tube 5. The tube diameters are selected so that the straight tube 5 fits snugly over the cord 3, but slides smoothly within the cane shaped tube 4 to raise or lower the bulb 1 within a stationary shade 6. The straight tube 5 also keeps the cord neat below the fixture. In the preferred embodiment, the straight tube 5 would be of resilient material, split lengthwise and slightly smaller in diameter than the cord 3, for a snug fit with the desired degree of friction. Another tube like the straight tube 5 may be provided to wrap around the cord 3 still further down, for those installations where more of the cord is visible. The shade 6 is lined with foil 7 to reflect light and reduce flammability. The reflected light not only increases efficiency, but also reduces glare by distributing the effective source of illumination. For reading, the bottom of the shade 6 should be about eye level and the bulb 1 lowered near the bottom of the shade 6. This configuration will illuminate laterally and downward, without shining in the reader's eyes. The adjustment is quick and easy to make with only one hand, without standing up. If there were no straight tube 5, it would be tedious to stuff the flexible cord 3 bit by bit into the cane shaped tube 4. When less lateral illumination is desired, the straight tube 5 is pulled downward to raise the bulb 1 and shift the balance of illumination upward.

Lowering the bulb 1 provides a much greater shift to lateral illumination than other arrangements provide by tilting the shade or by raising both shade and bulb. The foil lining 7 compounds this advantage, because the shift is much greater for reflected than direct illumination, as illustrated in FIG. 2. The reflected image of the bulb 8 is the same height as the actual bulb 1, but three times as far horizontally from the obscuring edge of the shade 6. Experience with this configuration has confirmed the prediction of prominence of lateral illumination.

In FIG. 1 a shade mount 9 is attached to the shade 6, and the cane shaped tube 4 passes through the mount 9.

FIG. 3 is a sectional view showing the means of mounting the lamp. Another tube, herein called a sheath tube 10 covers that segment of the cane shaped tube 4 that lies within the shade mount 9. The sheath tube 10 is attached, preferably welded, to a pair of brackets, herein called spring brackets 11 and 12 that fit over tWo mounting screws 13 and 14 on a wall 15. The spring brackets 11 and 12 are reinforced with washers 16 and 17 of thicker material. A push-on fastener 18 positions the sheath tube 10 vertically within the shade mount 9. Adhesive is used to prevent sliding of parts 4, 10, and 12 within the shade mount 9. FIG. 3 also shows how the straight tube 5 slides within the cane shaped tube 4 to move the electric cord 3 to adjust the height of the bulb.

FIG. 4 shows in detail a spring bracket 11 engaging a mounting screw 13. First the fixture is placed against the wall 15 as shown, with the lower end of the slot 19 over the screw 13. Then the fixture is slid downward. The spring bracket 11 is made of thin resilient material and bent at an acute angle, so it engages the head of the screw 13 with pressure and keeps the shade mount snug against the wall. The upper end of the slot 20 is slightly smaller in diameter than the head of the mounting screw 13, which has a conical surface, so that after installation the spring bracket 11 acts as a detent to resist lifting the fixture. This is desirable while adjusting the bulb to prevent lifting the fixture up and off the mounting screws. The resiliency of the spring brackets 11 and 12 also enables them to absorb minor shocks to the lamp that might otherwise loosen the mounting.

Figure 5:
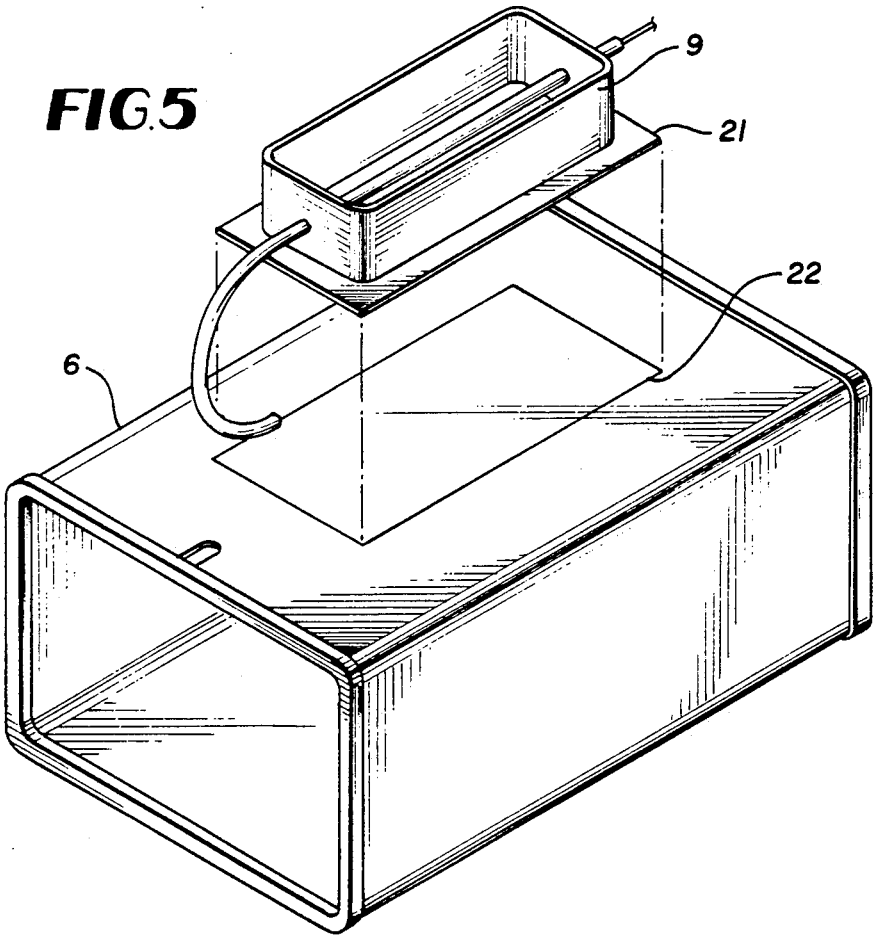
FIG. 5 shows the method of joining shade mount and shade.

In the preferred embodiment, the shade mount would be made separate and packed inside the shade for distribution. FIG. 5 shows how the customer would attach the shade mount 9 to the shade 6. The shade mount 9 is glued to an adhesive plate 21; after peeling off a protective sheet, the plate 21 is pressed onto a marked position 22 on the back of the shade 6. Then the straight tube 5 (FIG. 1) would be slid upward along the cord 3 until its top end is about an inch inside the cane shaped tube 4 when the bulb 1 is in its uppermost position.

Figure 6:
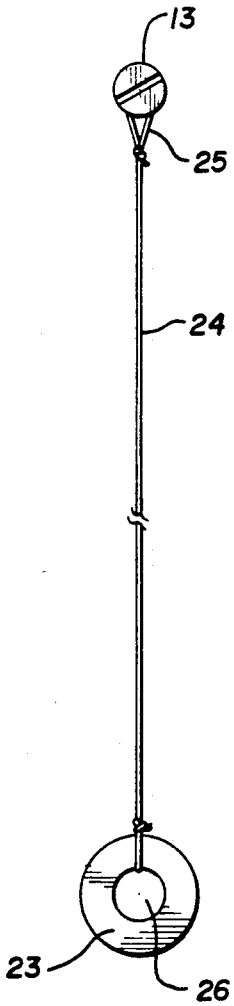
FIG. 6 shows a means for placement of mounting screws.

FIG. 6 shows how to position the mounting screws using a plumb-and-distance instrument that would be packed with each lamp; it comprises a washer 23 and attached line 24 with a loop 25. First the top screw 13 is installed the proper distance from the floor, depending upon how high the fixture is to be mounted. Then the loop 25 is placed over the screw 13, and the lower screw is installed at the center 26 of the washer 23.

In the preferred embodiment, both the shade and shade bracket are made of layers of corrugated paper, the kind with one surface corrugated and one surface smooth; this paper can easily be wrapped around a form and cemented together. Referring to FIG. 1, the shade mount 9 would be covered with foil to reflect the color and pattern of the wall, and to give the general impression of the shade 6 floating a short distance from the wall. An elastic plastic molding 27 and 28 covers the edges of the shade 6 and conceals the corrugations. The shade surface covering 29 can be changed by removing the molding 27 and 28 from both top and bottom edges, wrapping a new covering 29 around the shade 6 and taping it on the back side, trimming off any excess, and re-installing the molding 27 and 28. FIG. 3 shows the molding 27 and 28 in sectional view.

I claim:

1. A wall mounted lighting fixture in which the pattern of illumination can be adjusted by a means comprising:

a shade that is stationary with respect to a wall;

a cane shaped tube attached to said wall, with its curved segment terminating within said shade;

a straight tube that slides within said cane shaped tube;

a bulb and socket suspended within said shade by an electric cord that passes through both of said tubes, which cord has a diameter providing a tight fit within said straight tube so that said cord, socket and bulb may be moved by means of said straight tube.

2. A wall mounted lighting fixture as defined in claim 1, in which said shade is lined with reflective material.

3. A wall mounted lighting fixture as defined in claim 1, in which said shade is a rectangular tube with rounded corners.

4. A wall mounted lighting fixture as defined in claim 1, in which said straight tube is of resilient material, split lengthwise, and just large enough in diameter to fit snugly over said cord.

5. A wall mounted lighting fixture as defined in claim 1, in which a shade mount is fixedly attached to said shade, is detachably mounted on said wall, and has a reflective outer surface that is perpendicular to the wall surface.

6. A shade mount as defined in claim 5, which is attached to said shade by means of a flexible adhesive plate, which is positioned by means of markings on said shade.

7. A wall mounted lighting fixture as defined in claim 1, in which said shade has a core of corrugated paper.

8. A wall mounted lighting fixture as defined in claim 1, with an upper attachment and a lower attachment, each of which comprises:

a screw with a head that has a conical medial surface and that protrudes from the wall; and a strip of resilient material, with provision at its lower end for fixedly attaching said strip to said fixture, with its upper end bent away from the wall, and with a slot comprising a large hole at the lower end for placement over said screw head, a channel in the middle wide enough to slide over the shank of said screw, and a smaller hole at the upper end to cradle the conical surface of said screw after said fixture is lowered into place.

9. A wall mounted lighting fixture as defined in claim 1, in which both top and bottom edges of said shade are covered with a flexible molding that is fashioned to be easy to take off and put on, so that said shade can be easily re-covered.

10. A kit for measuring verticality and distance simultaneously in mounting said attachments as defined in claim 8, comprising:

a line and a loop at one end of said line to fit over said screw of said upper attachment; and a flat weight attached to the other end of said line, which weight indicates the position for said screw of said lower attachment.

* * * * *